United States Patent [19]

Graham et al.

[11] 4,172,866

[45] Oct. 30, 1979

[54] DRYING PROCESS FOR CASTING POWDERS

[75] Inventors: Donald H. Graham, Fort Ashby, W. Va.; Ralph F. Preckel, La Vale, Md.

[73] Assignee: Hercules Incorporated, Wilmington, Del.

[21] Appl. No.: 718,314

[22] Filed: Mar. 29, 1968

[51] Int. Cl.[2] ..... C06B 21/00

[52] U.S. Cl. ..... 264/3 E; 149/38; 149/42; 149/76; 149/92; 149/96; 149/97; 149/98

[58] Field of Search ..... 264/3; 149/96, 97, 92, 149/98, 42, 38; 34/9; 260/222

[56] References Cited

U.S. PATENT DOCUMENTS

| | | | |
|---|---|---|---|
| 2,554,179 | 5/1951 | Fordham | 149/98 X |
| 3,255,281 | 6/1966 | Alexander | 264/3 |
| 3,311,678 | 3/1967 | Brock et al. | 264/3 |
| 3,379,796 | 4/1968 | Newson et al. | 264/3 |

*Primary Examiner*—Stephen J. Lechert, Jr.
*Attorney, Agent, or Firm*—Michael B. Keehan

[57] ABSTRACT

Process for removal of residual "processing" solvent from propellant casting powder particles, following their manufacture, which comprises "liquid drying" the particles by contacting them with an organic liquid miscible with the processing solvent but exhibiting substantially no solvent action for the powder particle ingredients with substantially no penetration of the particles. Normally liquid hydrocarbons are exemplary liquid drying solvents of which n-heptane and n-hexane are now preferred.

In preferred practice the liquid drying solvent is maintained in substantially complete wetting relationship with the particle surfaces until emplacement of the particles for casting. This eliminates safety hazards involved in conventional heat drying of the green powder and subsequent handling of the resulting dry material.

18 Claims, No Drawings

DRYING PROCESS FOR CASTING POWDERS

This invention relates to the manufacture of propellants. In one aspect this invention relates to an extraction process for the removal of residual liquid solvent from a propellant casting powder containing same following manufacture of the casting powder. In another aspect this invention relates to process for the removal of residual "process solvent" from green casting powder, by liquid drying, and for maintaining the resulting liquid dried casting powder wet with the drying liquid up to and including initiation of the casting step, thereby eliminating safety hazards involved in conventional heat drying of the green powder and subsequent handling of the resulting dry material. Other aspects will be apparent in light of the accompanying disclosure and the appended claims.

In the manufacture of cast propellants, certain, if not all, propellant ingredients are formed into a particulate casting powder which is then introduced into a mold and cast by passing a suitable casting liquid through the resulting mass to fill the voids therein, followed by curing the resulting mass under time-temperature conditions to form the finished homogeneous solid propellant.

The casting powder is preferably any suitable single or double base smokeless powder formulation which, as is well known, includes various well-known supplemental ingredients such as one or more of ethyl centralite, diphenylamine, dibutylphthalate, potassium sulfate, and the like. Further exemplary of such casting powder formulations are those tabulated as follows:

| Casting Powder | Parts per Hundred Parts of Total Casting Powder | | | | |
|---|---|---|---|---|---|
| Formulation | 1 | 2 | 3 | 4 | 5 |
| Nitrocellulose | 91.0 | 75.0 | 40.0 | 30.0 | 20.0 |
| Nitroglycerin | | 17.0 | 27.5 | 10.0 | 10.0 |
| Ammonium Perchlorate | | | 30.0 | 28.0 | 7.0 |
| Cyclotetramethylene-tetranitramine | | | | | 36.0 |
| Aluminum powder | | | | 29.0 | 25.0 |
| Resorcinol | | | 1.5 | 2.0 | 1.0 |
| 2-Nitrodiphenylamine | 2.0 | 2.0 | 1.0 | 1.0 | 1.0 |
| Dioctyl Phthalate | 4.0 | | | | |
| Lead Stearate | 3.0 | | | | |
| Lead Salicylate | | 3.0 | | | |
| Lead Beta Resorcylate | | 3.0 | | | |

Generally, the individual ingredients for the casting powder are admixed with a sufficient amount of a suitable processing solvent to form an extrudable dough-like, or kneadable, mass. The doughy material is then formed into particles, oven dried, and passed to the mold assembly for casting. One such set of operations involves forming the dough-like mass and then extruding it into strands, cutting the doughy strands into granules, removing process solvent from the granules by oven drying, screening the dry granules to remove fines and oversized particles, passing the oven-dried granules to storage, transferring the dried granules from storage to the molding assembly and gravity dumping them into the mold unit, and casting the granules by passing a plasticizer into the voids in the granule mass followed by curing, generally under ambient temperatures over a period sufficiently long to effect swelling and gelation of the granules and hence the formation of a homogeneous mass of solid propellant exhibiting the required ballistic and mechanical properties.

The safety hazards involved in the handling of dry powder are numerous. As will be readily appreciated, the handling of dry casting powders during blending, shaping, screening, and the like, results in the generation of casting powder dust, and impingement, and interparticle friction, of dry particles as they are passed through any one or more of those operation steps, all of which cause high susceptibility of the particles to accidental initiation, especially by electrostatic charges inherently developed under those conditions.

This invention is concerned with method for removal of process solvent from the doughy casting powder mixture while generally maintaining the casting powder in a wet state up to and including its emplacement in the mold for the casting step, whereby safety hazards inherent in the usual oven drying and in the handling of dry casting powders are eliminated.

In accordance with the invention, casting powder particles containing residual process solvent, from manufacture of the casting powder, are liquid dried to remove the solvent so as to be in condition for casting to form a propellant. The liquid drying is carried out by contacting the casting powder particles with an organic solvent, as the drying liquid, which is miscible with the residual processing solvent, but which exhibits substantially no solvent action for the ingredients of the casting powder with substantially no penetration of the particles; the liquid drying action consisting of diffusion of the process solvent through the solid phase of the casting powder particles and passage of same from the particle surfaces into the drying liquid which is in direct contact therewith. The drying liquid essentially functions as an extraction solvent but in a unique manner, i.e. its selective solvent action occurs at the casting powder particle surfaces there being substantially no penetration of the drying liquid into the particle interior. Hence, drying liquids utilized in carrying out the process of the invention can also be referred to as extraction solvents and the process can be referred to as a solvent extraction, but with the above qualifications as to the uniqueness of both the extraction solvent and the process.

Although any liquid characterized by the above defined properties can be utilized as a drying liquid in practice of the invention, normally liquid saturated aliphatic hydrocarbons and mixtures thereof, particularly one or more of the group of hexanes, heptanes, octanes and nonanes, and preferably n-hexane, n-heptane, or n-hexane/n-heptane mixtures are advantageously utilized.

Exemplary processing solvents, well known in the art for manufacture of the above described dough-like casting powder particles are acetone, ethanol, i-propanol, n-propanol, n-butanol, i-butanol, toluene, ethyl acetate, n-butyl acetate, i-butyl acetate, tetrahydrofuran, methylethyl ketone, diethyl ketone and diethyl ether. These solvents have been employed alone or as mixtures in various ratios.

The invention is applied to the drying of casting powder particles of any suitable size or shape. However, in preferred practice the casting powder particles to be dried are granules cut from strand product of extrusion of the doughy mass; and accordingly, the casting powder particles are for the most part referred to herein simply as granules, it being understood, nevertheless, that the invention is not limited to that specific type particle.

The liquid drying of the invention can be carried out under any suitable contacting conditions. Generally the liquid drying is carried out over a time period of from 2 to 30 days at ambient temperatures ranging from 70° to 100° F., although somewhat higher temperatures can be employed, when desired, such as up to about 160° F., a range of from 60° to 160° F. being generally inclusive of the temperature conditions utilized, and ratio of drying liquid to the doughy particulate mass of casting powder, although dependent to a significant extent on concentration gradient of process solvent between the doughy mass and the drying liquid is generally within the range of 1:1 to 10:1, on a weight basis, although higher ratios, say up to about 15:1 can be advantageously utilized.

The invention is illustrated with reference to the following examples which demonstrate the removal of casting powder process solvent from "green" casting powder granules in accordance with the liquid drying of the invention.

EXAMPLE 1

700 grams (process solvent free basis) of a doughy mass of casting powder was formed by admixing the ingredients in the presence of about 295 grams of a mixture of acetone and ethanol, as processing solvent, in an acetone to ethanol liquid volume ratio of about 1.5:1. The doughy mass was then extruded into strands of circular cross-section having a diameter of about 0.145 inch followed by cutting the strands into "green" granules of about 0.150 inch lengths. The casting powder formulation (processing solvent free basis) was as follows:

| Ingredient | Weight % |
|---|---|
| Nitrocellulose | 28.0 |
| Nitroglycerin | 9.5 |
| Ammonium Perchlorate | 42.5 |
| Aluminum Powder | 14.0 |
| Resorcinol | 1.5 |
| 2-Nitrodiphenylamine | 1.0 |
| Zirconium Staples | 3.5 |

In each of a series of tests, a portion of the mass of green granules was contacted with n-heptane, which is miscible with the residual acetone-ethanol solvent in the granules but exhibits low solvent action, if any, for the granule ingredients. The tests were conducted under conditions of time, temperature and agitation to demonstrate not only liquid drying of the granules in accordance with the invention, but to also illustrate relationship of the above variables. All tests were conducted using 10 parts by weight n-heptane per part by weight (solvent free basis) of the mass of granules; and a sample of the granules was withdrawn from contact with the n-heptane at cumulative time intervals and analyzed for n-heptane, acetone, and ethanol as a measure of the degree of liquid drying accomplished, i.e. drying of the granules free of acetone-ethanol with substantially no penetration of the granules by the n-heptane. The resulting data are summarized in Table I.

TABLE I

| Granule Portion Tested, grams (dry basis) | Cumulative Time of Contact, minutes | Granule Analysis Weight Percent n-Heptane | Ethanol | Acetone | Total Acetone and Ethanol | Fraction of Originally Added Acetone and Ethanol |
|---|---|---|---|---|---|---|
| Test #1 - Contact at 77° F. | | | | | | |
| 100 | 0 | — | 4.39 | 8.67 | 13.06 | — |
| | 15 | .31 | 4.74 | 5.92 | 10.66 | .82 |
| | 30 | .15 | 4.25 | 4.92 | 9.17 | .70 |
| | 60 | .34 | 3.81 | 4.4 | 8.21 | .63 |
| | 120 | .08 | 2.83 | 3.70 | 6.53 | .50 |
| | 360 | .19 | 2.16 | 2.62 | 4.78 | .37 |
| | 1440 | .09 | 1.15 | 1.60 | 2.75 | .21 |
| Test #2 - Contact at 77° F. with agitation only first 360 minutes | | | | | | |
| 100 | 0 | — | 4.39 | 8.67 | 13.06 | — |
| | 15 | .12 | 4.25 | 5.46 | 9.71 | .74 |
| | 30 | .08 | 4.14 | 5.06 | 9.20 | .70 |
| | 60 | .09 | 3.36 | 4.22 | 7.58 | .58 |
| | 120 | .08 | 2.90 | 3.58 | 6.48 | .50 |
| | 360 | .08 | 2.26 | 2.68 | 4.94 | .38 |
| | 1440 | .09 | 1.15 | 1.60 | 2.75 | .21 |
| Test #3 - Contact at 100° F. | | | | | | |
| 100 | 0 | — | 5.68 | 8.33 | 14.01 | — |
| | 15 | .01 | 3.44 | 5.15 | 8.59 | .61 |
| | 30 | .06 | 3.41 | 5.14 | 8.55 | .63 |
| | 60 | .09 | 3.32 | 4.27 | 7.59 | .54 |
| | 120 | .08 | 2.65 | 3.49 | 6.14 | .44 |
| | 1440 | .27 | 0.71 | 1.34 | 2.05 | .15 |
| Test #4 - Contact at 120° F. | | | | | | |
| 100 | 0 | — | 5.68 | 8.33 | 14.01 | — |
| | 15 | .10 | 4.08 | 5.34 | 9.42 | .67 |
| | 30 | .10 | 3.36 | 4.48 | 7.84 | .56 |
| | 60 | .16 | 3.31 | 4.02 | 7.33 | .52 |
| | 120 | .14 | 2.05 | 2.71 | 4.76 | .34 |
| | 1440 | .40 | 0.89 | 1.33 | 2.22 | .16 |
| Test #5 - Contact at 140° F. | | | | | | |
| 100 | 0 | — | 5.68 | 8.33 | 14.01 | — |
| | 15 | .17 | 3.05 | 4.24 | 7.29 | .52 |
| | 30 | .17 | 2.86 | 4.04 | 6.90 | .49 |
| | 60 | .18 | 2.30 | 3.10 | 5.40 | .39 |
| | 120 | .17 | 1.38 | 2.68 | 4.06 | .29 |
| | 1440 | .41 | 0.41 | 0.73 | 1.14 | .081 |

The tests summarized in Table I demonstrate that with increase in contact temperature of the drying liquid and green casting powder particles, the rate of drying, i.e. removal of processing solvent from the green powder, is also increased.

EXAMPLE 2

A portion of another 700 gram mass of green casting powder having the same formulation as that of Example 1 and formed in accordance with the procedure of Example 1, including utilization of an acetone-ethanol processing solvent having the composition, and in the proportions shown in Example 1, was contacted with n-heptane at 140° F. in a series of tests to demonstrate liquid drying of the invention at that temperature level on a single 72-hour stage basis; and another portion of the same 700 gram mass of green granules was contacted in another series of steps, with n-heptane, under the same conditions and over the same time period except that the contacting was carried out in three separate stages of 24 hours each, i.e. after each 24-hour period the n-heptane was removed from contact with the casting powder and was replaced with fresh n-heptane. Both series of tests were conducted utilizing 10 parts by weight of high purity n-heptane to one part by weight of granular mass. In each test, a portion of the granules was withdrawn from contact with the n-heptane at the end of each cumulative period shown and analyzed as described with reference to Example 1. The data pertinent to these tests are summarized as follows:

TABLE II

| Granule Portion Tested, grams (dry basis) | Cumulative Time of Contact, minutes | Granule Analysis Weight Percent n-Heptane | Eth-anol | Acetone | Total Acetone and Ethanol | Fraction of Originally Added Acetone and Ethanol |
|---|---|---|---|---|---|---|
| Test #1 - (140° F.) Single Stage | | | | | | |
| 100 | 0 | — | 5.83 | 7.89 | 13.72 | — |
| | 24 | 0.61 | 0.35 | 0.52 | 0.87 | .063 |
| | 48 | 0.89 | 0.22 | 0.48 | 0.70 | .052 |
| | 72 | — | 0.23 | | | |
| Test #2 - (140° F.) 3 Stages, Each 24-hour Equilibrium | | | | | | |
| 100 | 0 | — | 5.83 | 7.89 | 13.72 | — |
| | 24 | 0.62 | 0.79 | 0.88 | 1.67 | .12 |
| | 48 | 0.53 | 0.13 | 0.31 | 0.44 | .032 |
| | 72 | 0.42 | 0.00 | 0.25 | 0.25 | .018 |

The data summarized in Table II demonstrate that multistage cycle operation provides for lower process solvent levels in the green casting powder and hence for an increase (over single stage) in drying efficiency.

EXAMPLE 3

Another 700 gram mass of green casting powder granules of formulation the same as that of Example 1 and formed in accordance with the procedure of Example 1, including utilization of acetone-ethanol processing solvent of the same composition and the same proportions as described in Example 1 was contacted under varied conditions of temperature, weight ratio of n-heptane to solid granule mass, and multi-stage extraction to illustrate the effect of those variables on liquid drying in accordance with the invention. In each test a portion of the granules was withdrawn from contact with the extraction solvent at the end of each cumulative time period and analyzed as described with reference to Example 1. The resulting data are summarized in Table III and demonstrate the effect of duration of contact on efficiency of drying action.

TABLE III

| Granule Portion Tested, grams (dry basis) | Cumulative Time of Contact, minutes | Granule Analysis Weight Percent n-Heptane | Eth-anol | Acetone | Total Acetone and Ethanol | Fraction of Originally Added Acetone and Ethanol |
|---|---|---|---|---|---|---|
| Test #1 - (140° F.) 1:1 Weight Ratio n-Heptane/Granules, Successive 24 hour Stages* | | | | | | |
| 120 | 0 | — | 4.04 | 7.64 | 11.68 | — |
| | 48 | 0.68 | 1.10 | 1.78 | 2.88 | .25 |
| | 72 | 1.14 | 0.92 | 1.23 | 2.15 | .18 |
| | 144 | 1.10 | 0.21 | 0.54 | 0.75 | .064 |
| | 192 | 0.91 | 0.17 | 0.33 | 0.50 | .043 |
| | 240 | 1.41 | 0.04 | 0.36 | 0.40 | .034 |
| | 336 | 1.50 | 0.04 | 0.19 | 0.23 | .020 |
| Test #2 - (77° F.) 1:1 Weight Ratio n-Heptane/Granules, Successive 24 hour Stages* | | | | | | |
| 120 | 0 | — | 4.04 | 7.64 | 11.68 | — |
| | 48 | 0.46 | 2.02 | 3.29 | 5.31 | .46 |
| | 72 | 0.42 | 1.50 | 2.41 | 3.91 | .34 |
| | 144 | 0.76 | 1.15 | 1.56 | 2.71 | .23 |
| | 192 | 0.66 | 0.80 | 1.02 | 1.82 | .16 |
| | 240 | 0.76 | 0.49 | 0.72 | 1.21 | .10 |

TABLE III-continued

| Granule Portion Tested, grams (dry basis) | Cumulative Time of Contact, minutes | Granule Analysis Weight Percent n-Heptane | Eth-anol | Acetone | Total Acetone and Ethanol | Fraction of Originally Added Acetone and Ethanol |
|---|---|---|---|---|---|---|
| | 336 | 0.82 | 0.42 | 0.62 | 1.04 | .089 |
| Test #3 - (77° F.) 10:1 Weight Ratio n-Heptane/Granules, Single Stage | | | | | | |
| 40 | 0 | — | 4.04 | 7.64 | 11.68 | — |
| | 72 | 0.34 | 1.81 | 2.49 | 4.30 | .37 |
| | 192 | 0.89 | 0.72 | 0.99 | 1.71 | .15 |
| | 336 | 0.61 | 0.22 | 0.52 | 0.74 | .063 |
| Test #4 - (77° F.) 1:1 Weight Ratio n-Heptane/Granules, Single Stage | | | | | | |
| 120 | 0 | — | 4.04 | 7.64 | 11.68 | — |
| | 72 | 0.79 | 2.60 | 4.26 | 6.86 | .59 |
| | 192 | 0.25 | 0.93 | 1.95 | 2.88 | .25 |
| | 336 | 0.54 | 0.22 | 0.52 | 0.74 | .012 |
| Test #5 - (77° F.) First 24 hours; (140° F. thereafter) 10:1 Weight Ratio n-Heptane/Granules, Successive 24 hour Stages* | | | | | | |
| 40 | 0 | — | 4.04 | 7.64 | 11.68 | — |
| | 24 | 0.5 | 1.99 | 3.82 | 5.81 | .50 |
| | 48 | 0.69 | 0.52 | 0.86 | 1.38 | .12 |
| | 72 | 0.53 | — | 0.27 | 0.27 | .023 |
| | 120 | 0.92 | 0.08 | 0.23 | 0.31 | .027 |
| | 168 | 0.96 | — | 0.18 | 0.18 | .015 |
| | 360 | 0.70 | — | 0.09 | 0.09 | .008 |

*At the end of each successive 24 hour period (independently of the intervals at which samples were analyzed) the n-heptane was removed from contact with the casting powder and replaced with fresh n-heptane of high purity.

It is to be noted that in some embodiments of the invention, there may be some loss of casting powder ingredient to the extraction solvent, dependent on extraction temperature level, the extraction solvent, and the particular casting powder ingredient. For example, when utilizing 99 percent purity n-heptane as the drying liquid, particularly at elevated temperatures, say, 120°–140° F. and nitroglycerin is a granule ingredient, there may be some loss of that ingredient to the extraction solvent. However, in such embodiments, it is only necessary to presaturate the drying liquid with the particular ingredient material(s) to thereby regulate the solubility equilibrium and minimize the ingredient loss. Further, such minor ingredient losses can be substantially eliminated, even without presaturation of the extraction solvent by downwardly adjusting the ratio of drying liquid to the casting powder mass to a level in the range of, say, from 0.5:1 to 1:1, and conducting the drying step at a suitable low temperature level, e.g. at 60°–80° F. However, in now preferred practice the drying liquid is presaturated with those ingredients exhibiting some solubility, per se, in the drying liquid, in order to minimize or substantially eliminate any such losses regardless of the low degree of loss that might be involved.

The invention provides for removal of process solvent from the casting powder particles by liquid drying without appreciable penetration of the drying liquid into the powder granules, as shown by the low n-heptane content of the granules, set forth in the examples. It is a feature of the invention that not only can the liquid drying of the granules be carried out by a unique solvent extraction procedure but that the solvent (drying liquid) penetration of the granules is substantially nil, which in turn provides for handling, storing, and moving the liquid dried granules while substantially completely wet at all surfaces by contact with at least a residual portion of the extraction solvent.

EXAMPLE 4

One pound of liquid dried casting powder granules of Example 1 is passed in a resulting wet state (n-heptane covering the granular surfaces) through plant lines into an upright mold for casting the granules to form a finished propellant. Residual n-heptane is drained from the emplaced granules followed by passage of a slow current of air therethrough to remove the last traces of the n-heptane from the granular surfaces. Nitroglycerin, 0.3 pound, is then passed through a lowermost portion of the mold assembly and upwardly through the interstices of the granules as a plasticizer or casting solvent, in accordance with conventional propellant casting practice and the resulting mass is then held in the mold at a temperature in the range of 70° to 77° F. for about 480 hours, followed by about 336 hours at a temperature of about 120° F. to effect the desired curing in the formation of the high burning rate solid double based propellant ready for firing as an energy source for driving a projectile.

In carrying out the casting step a casting solvent other than nitroglycerin can be employed, for example triacetin. Curing conditions generally involve a temperature in the order of from 120° to 140° F. over a period of from 168 to 816 hours dependent upon the particular propellant formulation involved, all in accordance with procedure well known in the art.

Although the invention has been specifically illustrated with reference to casting powders of double base type, it is also applicable to casting powders of other formulations such as those of the single base and composite types; the casting powder often containing, as residual processing solvent, acetone/ethanol mixtures in a liquid volume ratio of acetone to ethanol in the range of from 0.8:1 to 8.0:1.

As will be evident to those skilled in the art, various modifications can be made or followed, in light of the foregoing disclosure and discussion, without departing from the spirit or scope of the disclosure or from the scope of the claims.

What we claim and desire to protect by Letters Patent is:

1. In the drying of casting powder particles, of the single base, double base, modified double base, and composite types, containing residual processing solvent from their manufacture, to provide said casting powder particles in a dry state for casting to form a propellant, the improvement comprising contacting said particles with an organic solvent miscible with said residual processing solvent but exhibiting substantially no solvent action for the ingredients of said casting powder with substantially no penetration of said particles, sufficiently to cause said processing solvent to diffuse through said casting powder particles and escape along the surfaces thereof into said organic solvent to provide resulting liquid dried casting powder particles.

2. In a drying process of claim 1 maintaining at least a portion of said organic solvent in substantially complete wetting relationship with the surfaces of the resulting dried particles until emplacement of said particles for casting to form said propellant.

3. A process of claim 1 wherein said organic solvent is at least one normally liquid saturated aliphatic hydrocarbon.

4. A process of claim 2 wherein said organic solvent is at least one normally liquid saturated aliphatic hydrocarbon.

5. A process of claim 3 wherein said organic solvent is selected from the group consisting of hexanes, heptanes, octanes and nonanes, and mixtures thereof.

6. A process of claim 3 wherein said organic solvent is n-heptane.

7. A process of claim 3 wherein said organic solvent is n-hexane.

8. A process of claim 3 wherein the weight ratio of said organic solvent to said casting powder particles is within the range of from 0.5:1 to 15:1.

9. A process of claim 8 wherein the time and temperature of contact of said organic solvent with said casting powder particles are respectively within the range of within 2 to 30 days and from 60° to 160° F.

10. A process of claim 8 wherein said casting powder particles are cylindrical granules cut from a strand of green casting powder of circular cross-section.

11. A process of claim 9 wherein said liquid drying is carried out in a single stage.

12. A process of claim 9 wherein said liquid drying is carried out in a plurality of stages employing a separate portion of said organic solvent in each said stage.

13. A process of claim 9 wherein said organic solvent is saturated with at least one of the casting powder ingredients prior to contact with said casting powder particles.

14. A process of claim 9 wherein said temperature is within the range of from 60° to 80° F. and said ratio is not greater than 1:1.

15. A process of claim 9 wherein said organic solvent is n-heptane, and said processing solvent is a mixture of acetone and ethanol in an acetone/ethanol liquid volume ratio in the range of from 0.8:1 to 8.0:1.

16. A process of claim 9 wherein said casting powder is of a double base type formulation.

17. In a process of claim 2, emplacing said dried particles of casting powder covered with said organic solvent in a mold for casting, and then draining said organic solvent from the mass of particles, vaporizing residual organic solvent from the surface of the particles and casting the resulting mass of particles to form said propellant.

18. A process of claim 3 wherein said organic solvent is a mixture of n-hexane and n-heptane.

* * * * *